US006792694B2

(12) United States Patent
Lapierre

(10) Patent No.: US 6,792,694 B2
(45) Date of Patent: Sep. 21, 2004

(54) CONTROL SYSTEM FOR AN AUTOMATIC CLOTHES DRYER

(75) Inventor: Jacques Michel Lapierre, Montreal (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 10/455,342

(22) Filed: Jun. 6, 2003

(65) Prior Publication Data

US 2003/0230005 A1 Dec. 18, 2003

(30) Foreign Application Priority Data

Jun. 13, 2002 (CA) ..... 2390660

(51) Int. Cl.[7] ..... F26B 3/00

(52) U.S. Cl. ..... 34/446; 34/476; 34/493; 34/606

(58) Field of Search ..... 34/321, 364, 445, 34/446, 476, 493, 499, 552, 565, 576, 606, 140, 215, 218

(56) References Cited

U.S. PATENT DOCUMENTS 4,081,997 A * 4/1978 Losert ..... 73/168
4,275,508 A 6/1981 Jones
4,286,391 A * 9/1981 Gerry ..... 34/543
4,397,101 A * 8/1983 Rickard ..... 34/486
4,531,307 A 7/1985 Kuecker
5,291,667 A 3/1994 Joslin et al.
5,443,541 A * 8/1995 St. Louis ..... 34/486
5,444,924 A 8/1995 Joslin et al.
5,570,520 A 11/1996 Huffington
5,673,497 A * 10/1997 St. Louis ..... 34/486
5,755,041 A * 5/1998 Horwitz ..... 34/491
5,764,542 A 6/1998 Gaudette et al.
5,822,883 A * 10/1998 Horwitz ..... 34/494
5,860,224 A 1/1999 Larson
6,158,148 A * 12/2000 Krausch ..... 34/497
6,637,127 B2 * 10/2003 Reede et al. ..... 34/527

FOREIGN PATENT DOCUMENTS

CA 2039762 A1 10/1991

* cited by examiner

*Primary Examiner*—Ira S. Lazarus
*Assistant Examiner*—Kathryn S. O'Malley

(57) ABSTRACT

A control system for a clothes dryer has an inlet thermister located in the air flow system prior to the dryer drum to monitor the inlet temperature. This inlet temperature signal is provided to a microprocessor which samples this temperature over time and when this temperature exceeds a predetermined rate of increase with respect to time, the microprocessor generates an air flow restriction or blockage signal representing an air flow restriction or blockage in the dryer vent ducting.

11 Claims, 2 Drawing Sheets

CONTROL SYSTEM FOR AN AUTOMATIC CLOTHES DRYER

FIELD OF THE INVENTION

The present invention relates to a clothes dryer control system for detecting blockages in the dryer exhaust vent ducting.

BACKGROUND OF THE INVENTION

The installation of a customer's clothes dryer exhaust vent ducting is critical to the performance of the clothes drying appliance. Ducting that is either too long, has too many bends or is made of very flexible material can choke the airflow coming out of the dryer and thereby cause a reduction of the total system airflow speed through the drying chamber and out the exhaust vent ducting. This reduction in airflow speed causes inefficient operation of the clothes dryer heater system and may result in increased drying times for all types of loads and fabrics.

Clothes dryers currently utilize thermistors and electronic controls to monitor and control drying time and degree of dryness of clothes during different drying cycles. U.S Pat. No. 5,291,667 issued Mar. 8, 1994 and U.S. Pat. No. 5,444,924 issued Aug. 29, 1995 disclose a method of controlling a dryer by monitoring the air inlet temperature. When the monitored temperature exceeds a high limit temperature value a given number of times the dyer activates a blockage indicator.

While the use of an inlet temperature thermistor or thermostat to detect temperatures above a high limit inlet temperatures causing heaters to turn off is known, there still exist a need for determining the relative air flow restriction in the dryer vent ducting blockage prior to a high limit threshold being reached so as to permit continuous drying operation of the clothes dryer until the air flow restriction is corrected.

SUMMARY OF THE INVENTION

The present invention relates to a dryer control system that detects a decrease in airflow speed through the dryer due to an increase in air flow restriction by monitoring the rate of temperature rise at an inlet temperature sensor located upstream of the dryer drum.

Preferably, the control system estimates the equivalent airflow restriction caused by the customer's exhaust venting installation from temperature signals monitored by the inlet temperature sensor.

In accordance with the present invention there is provided a control system for an automatic clothes dryer having a clothes drying drum, an air inlet to the drum, an air outlet from the drum, means for flowing dryer air through the drum and heater means for heating the dryer air at the air inlet side of the drum. The system comprises a temperature sensor for sensing drum inlet temperature of the dryer air at the inlet side of the drum. The system further comprises a controller responsive to the drum inlet air temperature sensor for determining the time rate of increased change in the drum inlet temperature and generating an air flow blockage signal when the time rate of change of temperature exceeds a predetermined rate value.

Preferably, the inlet temperature sensor is positioned adjacent the heating elements of a clothes dryer and upstream of the drying drum in the direction of air flow through the dryer. The inlet temperature sensor generates a resistance signal that is read by a circuit as a voltage signal which is sent to a controller. The controller converts or transforms the voltage signal by a transfer function into a corresponding temperature value. The temperature values are processed in accordance with a detection algorithm that determines the change in temperature at the inlet temperature sensor position using the input signal from the inlet temperature sensor. The controller relates the rate of temperature change to an equivalent venting exhaust restriction and therefore, information relating to a qualitative evaluation of the customer's venting setup can be ascertained. This information can be 1) relayed back to the customer if he or she so desires by recalling the value (or qualitative evaluation) using a dryer user interface;
2) used subsequently by the dryer's controller to adjust displayed estimated drying times as well as to adjust the drying control cycle functions with respect to the customer's venting setup; and,
3) store the information for field technicians as a quick diagnostic tool.

BRIEF DESCRIPTION OF THE DRAWINGS

For a better understanding of the nature and objects of the present invention reference may be had to the accompanying diagrammatic drawings in which.

DETAILED DESCRIPTION OF THE INVENTION

Figure 1:
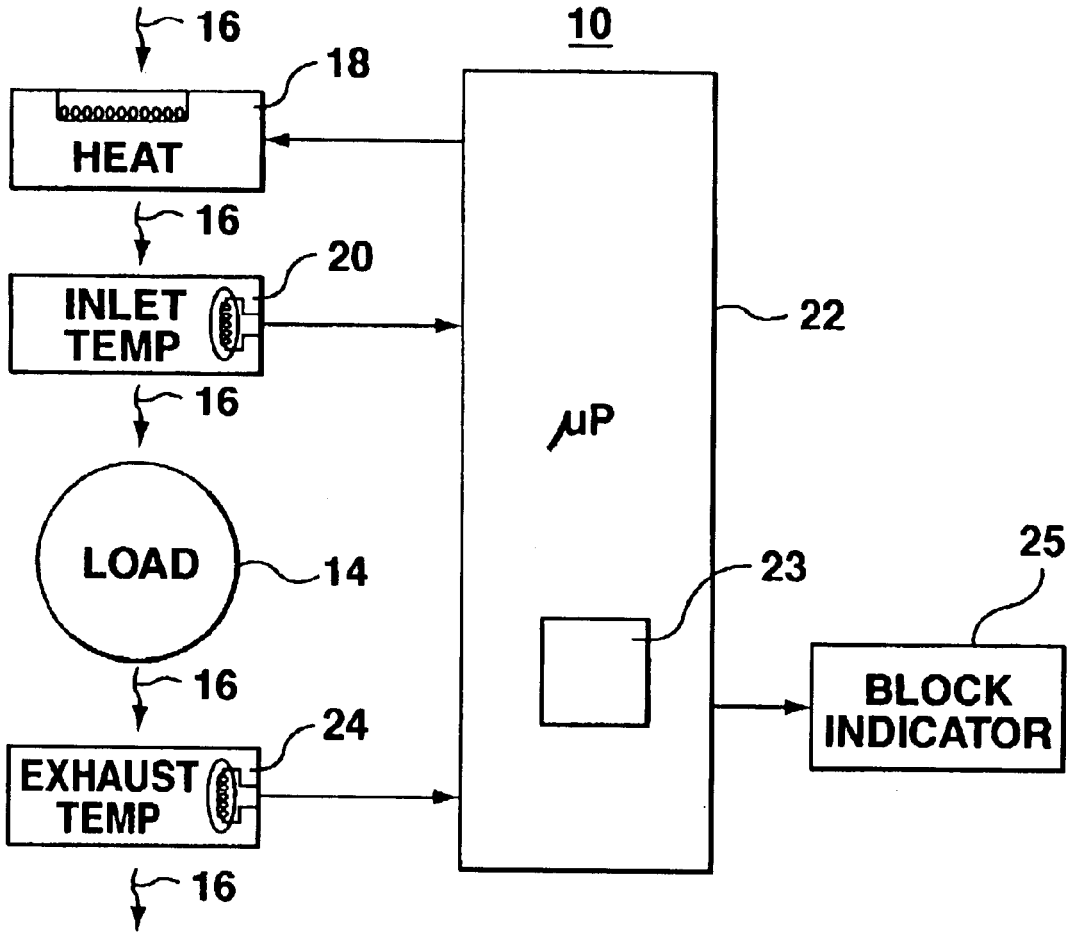
FIG. 1 is a schematic diagram of a clothes dryer control system according to the present invention.

Referring to FIG. 1, a control system is shown for use with an automatic clothes dryer 10 wherein the dryer itself may be of any well known construction having a clothes drying drum 14, an air inlet to the drum, an air outlet from the drum, and air mover or blower for flowing dryer air, as illustrated by arrows 16, through the drum 14 and out of the dryer 10. Generally as is well known, heater means 18, for example, an electrical resistance heater may be provided for heating the dryer air at the air inlet side of the drum 14 in well known manner. It should be understood that the heater means 18 may also comprise a combustion type of heater.

A temperature sensor or thermistor 20 is provided for sensing the temperature of the dryer air at the inlet side of the drum 14. Preferably, inlet thermistor 20 is placed in any convenient position within the inlet air flow so as to sense the temperature of the air flow without being directly influenced by direct radiation from the heater means 18. A suitable shield for this purpose may be provided. The signal output of inlet thermistor 20 is a resistance value that varies with temperature. The thermistor 20 is in a circuit (not shown) that produces a voltage signal that is coupled to a suitable control circuit in controller or microprocessor 22 where the voltage value associated with thermistor 20 is converted to a temperature value. The inlet air temperature sensed by thermistor 20 typically controls the heater means 18 to maintain the inlet air at a predetermined substantially constant temperature. The particular inlet air temperature is determined in accordance with the overall design of the dryer and may, for example, be 250 degrees F. In accordance with the present invention this constant value for the inlet temperature may be altered or modified during dryer operation by controlling energization of the heating means 18 in accordance with a dryer vent ducting blockage or air flow restriction.

A temperature sensor or thermister 24 senses the temperature of the dryer air at the outlet side of the drum 14. Microprocessor 22 is programmed in accordance with well known techniques to be responsive to outlet thermistor 24 to control the operation of the heater means, preferably heating elements, and thereby control the air temperature entering the dryer drum and also to initiate termination of the drying cycle in accordance with the sensed outlet temperature values.

The temperatures sensed from thermistor 18 are provided to controller or microprocessor 22 which is programmed to perform the functions described below. In addition, the controller 22 controls the display of information on a time to dry display, a dryness display, and an air blockage indicator 25.

Figure 2:
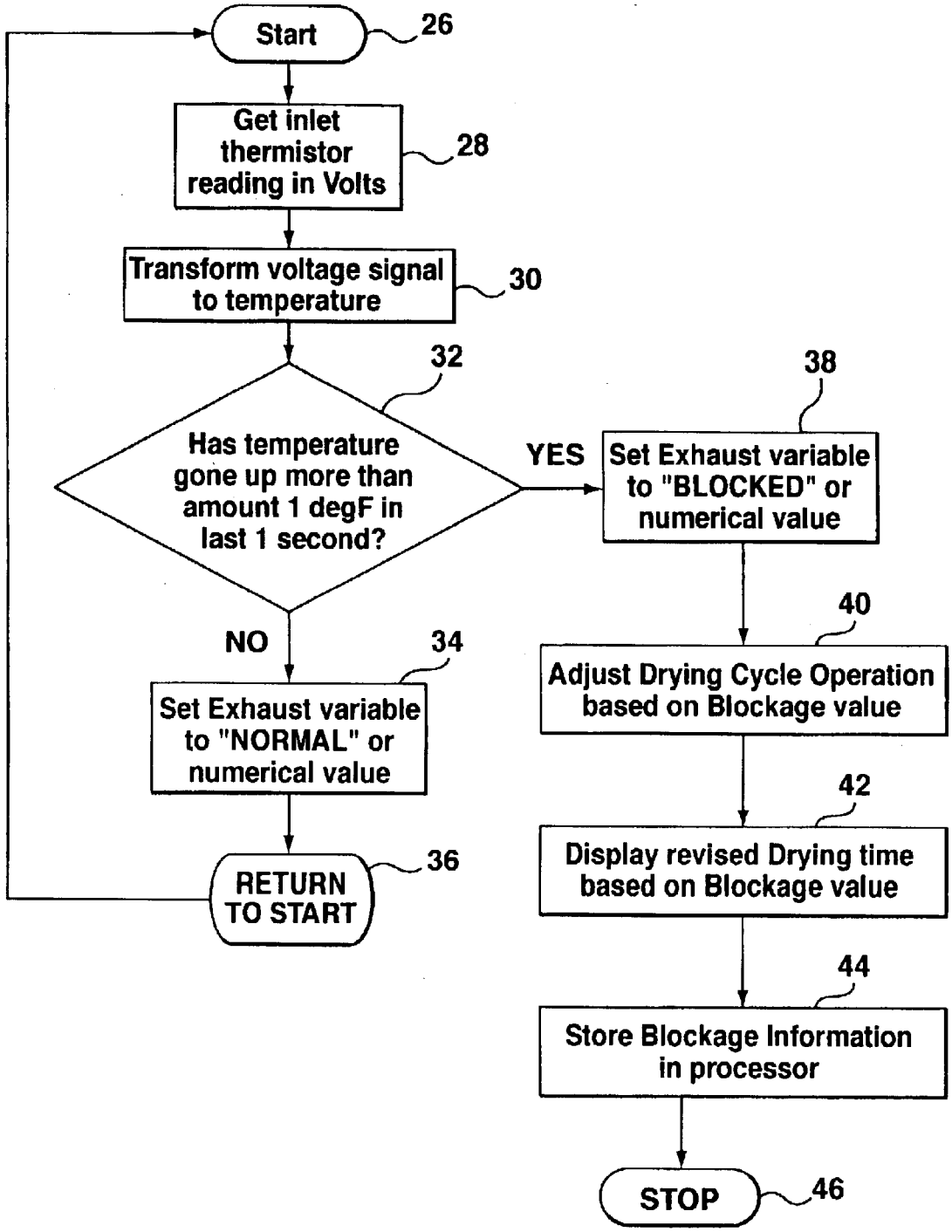
FIG. 2 is a flow chart diagram of a method according to the invention for detecting air blockage in the clothes dryer.

FIG. 2 shows a flow chart of a method and functions performed by the microprocessor 22 for detecting an air blockage or an air flow restriction in accordance with the present invention. The control method may be initiated at or during the starting of the dryer or once the dryer has come up to its operating temperature chosen for a particular cycle of operation. At this point the inlet thermistor 18 provides a reading in voltage at step 28 which is transformed by microprocessor 22 into a temperature signal at step 30. The microprocessor 22 at decision step 32 takes samples of the temperature readings from the thermister 18 and measures any change or differences in the temperature readings. In the event that any temperature rise is less than a rate of one degree F. per second, then the microprocessor sets an exhaust variable control to "NORMAL" or some numerical value associated with normal dryer operation. This normal value will be indicative of the fact the there is no air flow restriction or blockage in the dryer vent ducting that leads from the dryer to the outside environment. At this point, the processor at step 36 returns to the start again and proceeds to get another value for the therrmistor in volts to compare is with previous values.

In the event that the decision step 32 finds that the temperature rise is greater than 1 degree F. in one second, microprocessor 22 sets the exhaust variable to "blocked" or a numerical value indicative of the rate of change or rise greater than 1 degree F. in the last second. It should be understood that in the preferred embodiment the rate of temperature change over time is 1 degree F. per second. However, depending on the size of the dryer, and other dryer design parameters, this time rate of change at which the blocked indication will be generated may be at a different rate value. The microprocessor 22 may then use this numerical value for an indication of air flow restriction or blockage to adjust the drying cycle operation at step 40. This may involve reducing the energization of the heating elements to lower the inlet temperature of the dryer or may result in the complete de-energization of the heating elements in the event that the numerical rate value is greater than a predetermined rate value which indicates that there is a complete blockage in the exhaust vent ducting which could result in unsafe operating conditions. The microprocessor 22 then displays at step 42 a revised drying time based on the blocked value. Accordingly, if the drying time was to be 30 minutes and there was a partial blockage, this could be readjusted to read 35 or 40 minutes.

Further, the microprocessor 22 is provided with memory 23 (FIG. 1) which stores blockage information or a history of this information in the dryer so that a technician can later determine if there had been any problems with the air flow through the dryer vent ducting.

After this stage, the microprocessor 22 ends the blockage detection at step 46. Alternatively, the testing could continue with new values being continued to be monitored by the inlet thermister 20 so that the whole process of air flow restriction can be modified on an ongoing basis during the drying cycle.

It should be understood that alternative embodiments of the present invention may be readily apparent to a person skilled in the art in view of the above description for the preferred embodiments of this invention. Accordingly, the scope of the present invention should not be limited to the teachings of the preferred embodiments and should be limited to the scope of the claims that follow.

What is claimed is:

1. A control system for an automatic clothes dryer having a clothes drying drum, an air inlet to the drum, an air outlet from the drum, means for flowing dryer air through the drum and heater means for heating the dryer air at the air inlet side of the drum, the system comprising:

a temperature sensor for sensing drum inlet temperature of the dryer air at the inlet side of the drum;

a controller responsive to the drum inlet air temperature sensor for determining the time rate of increased change in the drum inlet temperature and generating an air flow blockage signal when the time rate of change of temperature exceeds a predetermined rate value.

2. The control system of claim 1 further including memory for storing the air flow blockage signal in the dryer.

3. The control system of claim 1 wherein the air flow blockage signal is representative of the air flow restriction in the dryer vent ducting.

4. The control system of claim 1 wherein the controller adjust the drying cycle time duration displayed in accordance with the air flow blockage signal.

5. The control system of claim 1 wherein the controller adjusts heater energization in accordance with the air flow blockage signal.

6. The control system of claim 1 a time rate of change in temperature greater than 1 degree F. per second is representative of an air flow restriction.

7. A method for controlling an automatic clothes dryer having a clothes drying drum, an air inlet to the drum, an air outlet from the drum, means for flowing dryer air through the drum and heater means for heating the dryer air at the air inlet side of the drum, the method comprising the steps of:

sensing drum inlet temperature of said dryer air at the inlet side of the drum;

determining time rate of increased change in the drum inlet temperature; and, generating an air flow restriction signal indicative of blockage in the dryer vent ducting when the time rate of change of temperature exceeds a predetermined rate value.

8. The method of claim 7 further including the step of storing the air flow blockage signal in the dryer.

9. The method of claim 7 wherein further comprising the step of adjusting the drying cycle time duration displayed in accordance with the air flow restriction signal.

10. The method of claim 7 further comprising the step of adjusting heater energization in accordance with the air flow restriction signal.

11. The method of claim 7 wherein the step of determining the time rate of change results in the generating step when the time rate of change in temperature is greater than 1 degree F. per second.

* * * * *